United States Patent [19]

Arai

[11] 4,260,268

[45] Apr. 7, 1981

[54] DEVICE FOR DRIVING DOT PRINTING BARS IN A DOT PRINTER

[75] Inventor: Kiyoyuki Arai, Tokyo, Japan

[73] Assignee: Copal Company Limited, Tokyo, Japan

[21] Appl. No.: 42,034

[22] Filed: May 24, 1979

[30] Foreign Application Priority Data

May 29, 1978 [JP] Japan ..... 53/064141

[51] Int. Cl.[3] ..... B41J 3/12

[52] U.S. Cl. ..... 400/121; 101/93.04; 400/124

[58] Field of Search ..... 400/121, 124, 125, 125.1; 101/93.04, 93.05, 93.30, 93.31

[56] References Cited

U.S. PATENT DOCUMENTS

| | | | |
|---|---|---|---|
| 2,897,752 | 8/1959 | Malmros et al. | 101/93.30 |
| 3,302,557 | 2/1967 | Simpson | 400/124 X |
| 3,795,187 | 3/1974 | Babler | 101/93.30 X |
| 3,929,067 | 12/1975 | Nishikawa et al. | 101/93.30 |
| 4,174,182 | 11/1979 | Lendl | 400/124 |

FOREIGN PATENT DOCUMENTS

| | | | |
|---|---|---|---|
| 52-6421 | 1/1977 | Japan | 400/124 |

*Primary Examiner*—Paul T. Sewell

*Attorney, Agent, or Firm*—Haseltine and Lake

[57] ABSTRACT

The device for driving dot printing bars in a dot printer comprises a recording paper holding and feeding platen, dot printing bars reciprocally movable between an inoperative position and an operative position, a common rotary friction roller normally held in a predetermined spaced relationship to the bars and adapted to be engaged by the bars when the bars effect dot printing, electromagnetic devices associated with the bars to cause the bars to strike against a recording paper to effect dot printing on the paper and a control circuit operating the electromagnetic devices.

3 Claims, 7 Drawing Figures

DEVICE FOR DRIVING DOT PRINTING BARS IN A DOT PRINTER

BACKGROUND OF THE INVENTION

This invention relates to a device for driving dot printing bars in a dot printer and more particularly, to a device for driving dot printing bars in a dot printer in which when a dot printing bar of bars selectively contact a friction roller which rotates continuously or intermittently, the bar or bars spring out to effect dot printing on a recording paper.

There have been proposed and practically employed a variety of devices for driving dot printing bars in dot printers and in one of the priorart dot print bar drive devices, flexible wires or bars are connected to the movable portions (movable iron pieces, for example) fo their respectively associated electromagnetic devices and one or more of the wires or bars spring out selectively as one or more of the movable iron pieces are attracted to an electromagnet or electromagnets to be caused to rock whereby the bar or bars effect dot printing on a recording paper.

Therefore, in such a prior art dot printing bar drive device, since it is necessary to space the movable iron piece from the pole portion of the associated electromagent by a distance corresponding to the protruding or spring-out distance of the wire or bar or convert the rocking movement of the movable iron piece as the iron piece is attracted to the electromagnet into the spring-out or protruding force of the wire or bar, the electromagneticdevice is required to be large in size or the time space which will elapse from the inputting of a selection command to the actual operation of the wire or bar is relatively longer as compared with the spring-out of protruding distance of the wire or bar which becomes an impediment in reducing the size of the bar drive device and/or accelerating the dot printing speed.

SUMMARY OF THE INVENTION

Therefore, the present invention is to provide a novel and improved device for driving dot printing bars in a dot printer which can effectively eliminate the disadvantages inherent in the prior art dot printing bar drive device referred to hereinabove.

The purpose of the present invention is to provide a device for driving dot printing bars in a dot printer in which the attaction by the electromagnetic device will not directly affect on the spring-out or protrusion of the dot printing bar, but exclusively serve as a selection signal to thereby minimize the size of the bar drive device and accelerate the dot printing speed.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

PREFERRED EMBODIMENTS OF THE INVENTION

Figure 1:
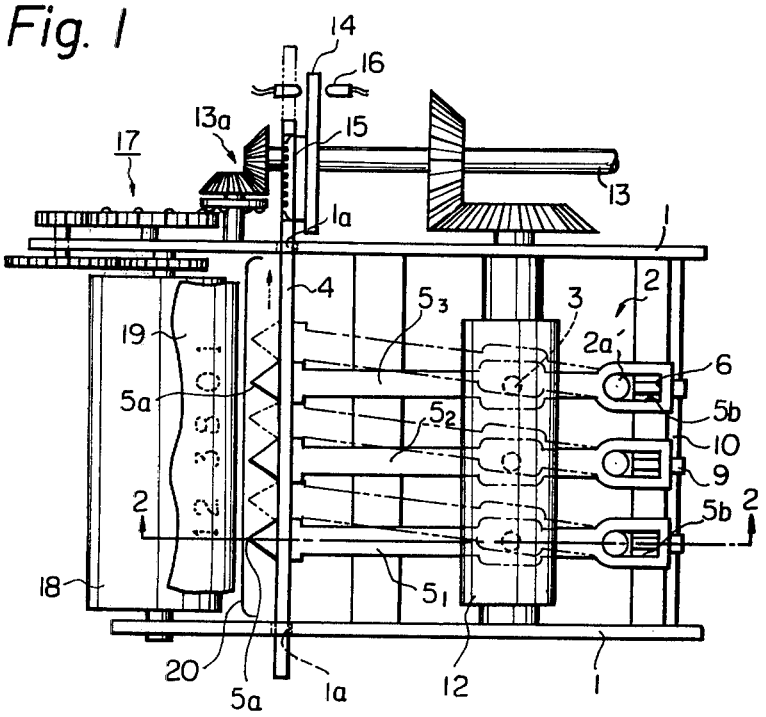
FIG. 1 is a top plan view of a first embodiment of bar drive device constructed in accordance with the present invention.

The present invention will be now described referring to the accompanying drawings which show preferred embodiments of the invention. First, referring to FIGS. 1 and 2 inwhich a dot printer having the first embodiment of bar drive device of the invention incorporated therein is shown. In these Figures, reference numeral 1 denotes a pair of parallel and spaced side plates which have aligned guide grooves 1*a* for slidably receiving a bar guide plate 4 which is adapted to slidably move at right angles to the side plates 1 relative to the latter in the manner as will be described hereinafter. Reference numberal 2 denotes a casing retained between the side plates 1 and the casing is formed of resin or the like having excellent wear-resistant, impact-resistant and heat-resistant properties. As more clearly shown in FIG. 2, the top wall 2*a* of the casing 2 has a plurality of spaced stops 2*a'* formed integrally therewith and the casing also has in a lower portion thereof a plurality of holes 2*c* for each receiving one pole piece 9*a* of each of a plurality of stationary cores 9 of which description will be made hereinafter and a plurality of annular recesses for each receiving a coil 11 thereabout.

Figure 2:
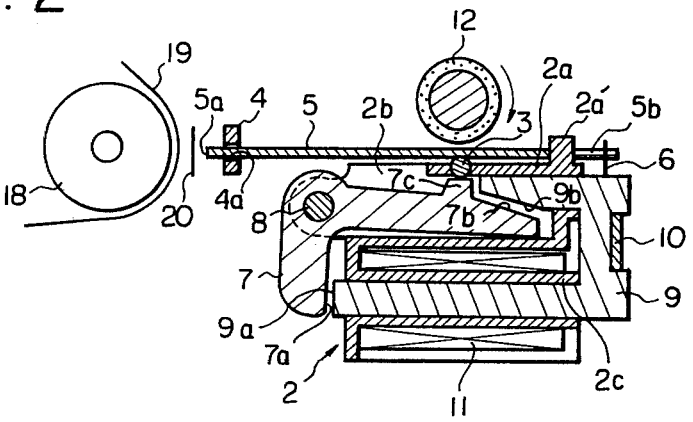
FIG. 2 is a cross-sectional view taken along substantially the line 2—2 of FIG. 1.

Reference numberal 3 denotes balls formed of metal or resin and received and guided in holes formed in the top wall 2*a* of the casing 2 for vertical movement therein (as seen in FIG. 2). The balls 3 project partially above and below the top wall 2*a* of the casing 2. The guide plate 4 has guide holes 4*a* formed therein for slidably receiving bars 5 (bars $5_1$, $5_2$ and $5_3$) of which description will be made hereinafter and is reciprocally and slidably moved in the guide grooves 1*a*, of the side plates 1 by means of an eccentric cam 15. The bars $5_1$, $5_2$ and $5_3$ are formed of hard sheet metal which stands against a striking force producted in dot printing which will be delivered to the bars and the leading end face 5*a* of each of the bars has a regular square cross-section corresponding to a dot which constitutes one element of a particular dot character. The bars $5_1$, $5_2$ and $5_3$ are guided at areas thereof adjacent to the leading ends within the coresponding guide grooves 4*a* and at the rear ends by means of grooves 5*b* which are formed at the bar rear ends and loosely fitted on the stops 2*a'* on the casing top wall 2*a* for slidable movement leftwards and rightwards (in the longitudinal directionas seen in FIG. 1. However, the bars $5_1$, $5_2$ and $5_3$ are normally biassed rightwards or to the retracted position by means of leaf springs 6 which are secured to the upper surfaces of the rear ends of the other pole pieces of the cores 9 as shown in FIG. 1 in which the left-hand ends of the grooves 5*b* of the bars $5_1$, $5_2$ and $5_3$ abut against the respectively associated stops 2*a'*. As more clearly shown in FIG. 1, the width of the bars $5_1$, $5_2$ and $5_3$ is enlarged in an intermediate portion of the associated needle between the leading and rear ends thereof and the undersurfaces of the enlarged intermediate portions are adapted to contact the upper surfaces of the balls 3 when the bars are in the retracted position whereas the upper surfaces of the intermediate portions are maintained spaced from a rotary friction roller 12 of which description will be made hereinafter in the retracted position of the bars. However, this space may be a very small amount for the purpose of the present invention.

Reference number 7 denotes movable armatures each having a contact face *7a* facing the pole piece *9a* of the corresponding stationary core 9, a contract face *7b* facing the pole piece *9b* of the same stationary core 9 and a ball abutment face *7c*. The movable armatures 7 are rockably mounted on a common shaft 8 with wall portions *2b* of the casing 2 interposed between the adjacent two movable cores 2 which shaft 8 is in turn fixedly secured at the opposite ends to the side plates 1, but are normally urged in the clockwise direction by their own gravity to the position as shown in FIG. 2 in which the contact faces *7b* of the movable armatures 7 abut against the upper surfaces of the walls defining the annular recesses in the casing 2 which receive the coils 11. Although the ball abutment faces *7c* of the movable armatures 7 may or may not contact the balls 3 when the movable armatures 7 are in the position of FIG. 2, the core faces *7c* preferably contact the balls.

The stationary cores 9 having the pole pieces *9a*, *9b* are held in position within the casing 2 by means of a plate 10 which is in turn fixedly secured to the casing 2 and side plates 1. The armatures 7 and cores 9 are formed of magnetic material. Each of the coils 11 is formed of a self-fusion wire and disposed within the associated annular recess in the casing 2 surrounding the pole piece *9a* of the associated stationary core 9.

The rotary friction roller 12 is formed of great friction efficient material such as rubber and rotated continuously or intermittently in the clockwise direction as shown by the arrow in FIG. 2at a predetermined rate by a drive motor (not shown) each time the drive device receives a printing signal from a source (not shown).

The eccentric cam 15 is supported by a drive shaft 13 which is integrally secured to a detection plate 14 and the shaft is rotated by the abovementioned drive motor (not shown). The detection plate 14 is adapted to selectively cooperate with photoelectric elements 16 in providing a signal in synchronization with a lateral movement in the figure direction of the guide plate 4 and accordingly, of the bars $5_1$, $5_2$ and $5_3$. The eccentric cam 15 engages the opposite longitudinal ends of an elongated recess formed in the guide plate 4 to cause the guide plate 4 to make one reciprocal movement in the longitudinal direction thereof each time the eccentric cam 15 makes one complete rotation. Reference numeral 17 denotes an intermittent rotation mechanism which is set so as to intermittently response to the rotation of the eccentric cam 15 through a bevel gear set 13*a* interlocked with the drive shaft 13 whereby a platen 18 is rotated by a predetermined angular distance per each one half rotation of the eccentric cam 15. Reference numeral 19 denotes a recording paper adapted to be fed in increment as the platen 18 rotates and reference number 20 denotes an inked ribbon.

In the embodiment described hereinabove, characters in six are printed by the three bars and accordingly, the three bars $5_1$, $5_2$ and $5_3$ are shown as being arranged in parallel to each other. Therefore, the stops *2a'*, the balls 3, the guide grooves *4a* in the guide plate 4 and the leaf springs 6, the movable armatures 7, the stationary cores 9 and the coils 11 should be employed in the number corresponding to the number of the bars employed. As more clearly shown in FIG. 1,the bars $5_1$, $5_2$ and $5_3$ move reciprocally in synchronization with each other between the solid line and two-dot chain line positions as shown in FIG. 1 and each bar is adapted to print two figures. In the embodiment illustrated, the bar $5_1$ prints ones of figure and tens of figure, the bar $5_2$ prints hundred of figure and thousands of figure and the needle $5_3$ prints ten thousands and hundred thousands of figure, for example.

Figure 3:
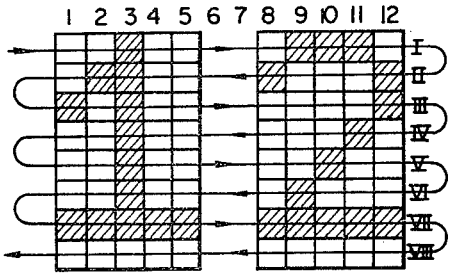
FIG. 3 is an enlarged view showing characters formed of dots.

In the embodiment described hereinabove, one character consists of a "5×7" dot matrix as shown in FIG. 3 and accordingly, the detection plate 14 is formed with twelve (5+5+2) detection holes including the space corresponding to the area of two dots left between each two adjacent figures.

The operation of the bar drive device of the invention described hereinabove will be now described.

First, the bar driving operation by which the present invention is characterized will be described referring to FIG. 2. In the positions of the components of the bar drive device as shown in FIG. 2, the rotary friction roller 12 is rotating in the clockwise direction as seen in FIG. 2. When electric current is supplied to and flows through one selected coil 11, the stationary core 9 associated with the selected coil is energized to attract the contact faces *7a* and *7b* of the associated movable armatures 7 thereto to thereby cause the movable armatures 7 to rock about the shaft 8 in the counter-clockwise direction as seen in FIG. 2. The rocking movement of the movable armature 7 in the counter-clockwise direction pushes the associated ball 3 upwardly by means of the contact face *7c* of the armature 7 which in turn pushes the bar of bars $5_1$, $5_2$ or $5_3$ whereby the upper surface of the bar contacts the rotary friction roller 12. Therefore, the bar $5_1$, $5_2$ or $5_3$ springs out leftwards under the frictional force produced by the contact between the bar and roller 12 against the biasing force of the leaf spring 6 whereupon the leading end *5a* of the bar strikes against the recording paper 19 through the inked ribbon 20 so as to print a dot on the paper 19.

Since the drive device is so set that when the dot printing operation has completed, the supply of electric current to the selected coil 11 is shut off, the associated movable coil 7 is allowed to rock about the shaft 8 by its own gravity in the clockwise direction as seen in FIG. 2. Therefore, after the dot printing operation, the bar which has been urged against the outer periphery of the roller 12 is released from the engagement with the roller under the restoration force of the outer periphery of the roller 12 to cause the movable armature 7 to rock about the shaft 8 in the clockwise direction through the ball 3. At this time, the gravity of the bar and that of the movable armature 7 assist the clockwise rocking movement of the movable core 7. The rocking movement of the movable armature 7 in the clockwise direction permits the bar to disengage from the friction roller, at which time the bar is moved rightwards by the leaf spring into abutment with the stop *2a*, and is held stationary.

The dot character forming operation will be now described referring to FIG. 3.

First, the motor (not shown) is rotated in response to a printing command input or signal. The rotation of the motor in turn rotates the rotary friction roller 12 in the clockwise direction through the drive shaft 13 and bevel gear set 13*a*. Meantime, the guide plate 4 commences its slidable movement in the arrow direction as shown in FIG. 1 in response to the rotation of the eccentric cam 15. The movement of the guide plate 4 in this direction causes the bars $5_1$, $5_2$ and $5_3$ to initiate their rightward movement in the figure direction about the stops 2*a* as seen in FIG. 1. As the group of the bars moves in the figure direction, the movement of the bar group in the figure direction is detected by the detection plate 14 which detects twelve dot positions for each bar. In the movement of the bar group over the first column, when the bar $5_1$ reaches the third dot position, the ninth dot position, the tenth dot position and eleventh dot position, respectively, a print selection signal is provided to the coil 11 associated with the bar $5_1$ whereupon the bar $5_1$ springs out or protrudes as mentioned hereinabove so as to print a dot corresponding to the signal on the recording paper. Similarly, necessary dots are printed in the first column of each of the hundred of figure, thousands of figure, ten thousands of figure and hundred thousands of figure.

When the bar $5_1$ passes the twelfth dot position as the needle moves, the guide plate 4 moves back in the reverse direction to the initial position as the eccentric cam 15 rotates in the remaining half angular distance of its one complete rotation. As the bar $5_1$ moves back to the initial position, just before the bar $5_1$ reaches the twelfth dot position again, the platen 18 is caused to rotate by one pitch of the dot column through the intermittent rotation mechanism 17 to feed the recording paper 19 by the distance corresponding to the pitch between adjacent dots in a particular matrix. Thus, thereafter, as the bar $5_1$ moves from the twelfth dot position through the intermediate dot positions to the first dot position, the corresponding dots in the second column are printed in accordance with a selection signal. Similarly, the dots in the third-seventh columns are in succession printed on the recording paper each time the recording paper is fed by one pitch to thereby provide prints of the characters "1" and "2" in the ones of figure and the tens of figure, respectively.

Figure 4:
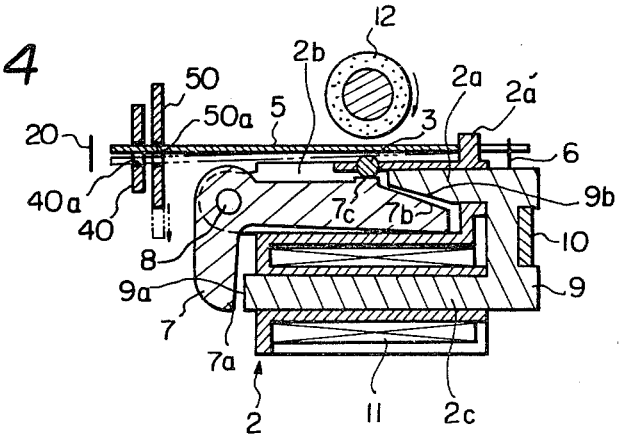
FIG. 4 is a fragmentary side elevational view of a second embodiment of bar drive device constructed in accordance with the present invention.
Figure 5:
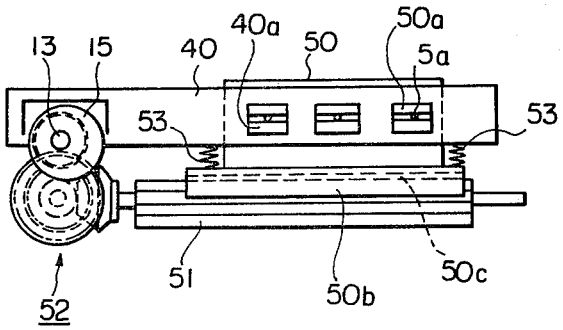
FIG. 5 is a front elevational view of said second embodiment of bar drive device as shown in FIG. 4.

Now, description will be had on the second embodiment of the invention referring to FIGS. 4 and 5.

In the first embodiment described hereinabove, dot characters in one line are printed by a combination of the movement of the bars in the lateral direction and the increment feed of the recording paper by one pitch. However, in the second embodiment of FIGS. 4 and 5, dot charactors in one line are printed by a combination of the movements of the bars in the lateral and longitudinal directions and the recording paper is fed in increment only after dot characters in one line have been printed.

The construction and arrangement of the components of the second embodiment of bar drive device of the invention will be now described.

In FIGS. 4 and 5, reference numberal 40 denotes the bar guide plate which is provided with a plurality of spaced guide grooves 40*a* having a greater dimension in the vertical direction than in the horizontal direction and as in the first embodiment described hereinabove, the bars 5 ($5_1$, $5_2$ and $5_3$) are guided in the respectively associated guide grooves 40*a* in the lateral direction of the grooves with the freedom of movement in the vertical direction of the grooves. The guide plate 40 is supported by and guided in the abovementioned side plates 1 (not shown in FIGS. 4 and 5) for reciprocally lateral movement by the eccentric cam 15 in the same manner as described in connection with the first embodiment.

Reference numeral 50 denotes an auxiliary guide plate which is provided with a plurality of rectangular guide grooves 50*a* (corresponding to the guide grooves 40*a* in number) for each guiding the associated bar along all the four sides of the guide groove 50*a* while restraining the bar from moving relative to each other in the vertical and horizontal directions. The auxiliary guide plate 50 is urged against a stepped cam 51 of which description will be made hereinafter by means of compressed springs 53. More particularly, the auxiliary guide plate 50 has an arcuate piece 50*b* of arcuate cross-section riding over the underlying stepped cam 51 and is provided with a slide projection 50*c* in abutment against the cam faces of the stepped cam 51 so that the auxiliary guide plate 50 can slide along the cam faces together with the guide plate 40 in the longitudinal direction of the latter. The stepped cam 51 is formed with eight discrete cam faces so that the cam 51 can rotate by an angular distance corresponding to one eighth one complete rotation thereof each time the abovementioned eccentric cam 15 rotates one half its one complete rotation to vertically deflect the bars by one pitch of the dot column subsequent ot each scanning movement of the bars. Reference numeral 52 denotes a rotary reduction gear mechanism. The other parts of the second embodiment are identical with or similar to the corresponding parts of the first embodiment of FIGS. 1 and 2 and therefore, the same numerals are assigned to the identical or similar parts of the second embodiment of FIGS. 4 and 5.

The character printing operation of the second embodiment of bar drive device for printing the characters as shown in FIG. 3 will be now described.

First, the rotary friction roller 12 rotates in the clockwise direction as seen in FIG. 4 in response to a printing command input and the eccentric cam 15 is rotated to cause the guide plates 40, 50 to slide as a unit in the counter-clockwise direction as seen in FIG. 5 or from the first dot position toward the twelfth dot positon in FIG. 3. Duirng the slidable movement of the guide plates 40, 50, the dots in the first column are in succession printed. By the time the eccentric cam 15 completes its one half rotation, the printing of the first column has been completed and thereafter, as the eccentric cam initiates the other half rotation, the guide plates 40, 50 slide in the reverse direction or rightwards. By the time, since the stepped cam 51 has rotated an angular distance corresponding to one eighth its one complete rotation, only the guide plate 50 slides downwardly together with the bars by means of the slide projection 50*c* on the arcuate piece 50*b* engaging the stepped cam 51. The downward slidable movement amount of the guide plate 50 corresponds to the pitch distrance betwen adjacent dots in the matrix. Thus, as the guide plates 40, 50 slide rightwards, the leading end faces of the bars tilt downwardly by an amount corresponding to one eighth the distance between the solid line and two-dot chain line as shown in FIG. 4 to assume the position for printing dots in the second column. During the clockwise rotation of the bars in response to the slidable movement of the guide plates 40, 50, i.e., leftward shifting movement as seen in FIG. 3, the dots in the second column are in succession printed from the twelfth dot position to the first dot posiiton in the order. Thereafter, as the stepped cam 51 rotates intermittently in increment in response to the rotation o the eccentric cam 15, the bars displace downwardly in increment whereby dots in the third-seventh columns are printed to thereby provide desired dot characters.

The construction and arrangement of the components of the first embodiment of printer as shown in FIGS. 1 and 2 are basic ones and the present invention is, of course, not limited to the construction and arrangement. For example, the number of dots forming a character, the number of character figures and the number of character figures assigned to one bar are not limited to those described hereinabove. Furthermore, the electromagnetic device may be also of the type in which the bars are actuated when the device is turned on the off-type, the plunger-operated type or the type in which a reverse excitation acts on the permanent magnet or magnets.

Figure 6:
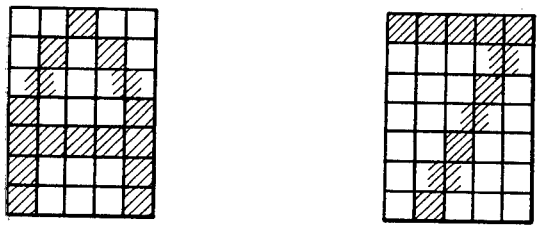
FIG. 6 is an enlarged view showing characters formed of half dots.

As to the character style, when half dots are employed, characters similar to handwriting ones are provided as shown in FIG. 6. Such half dot printing is possible by retarding a dot selection signal to be produced in response to a position signal for the lateral slide movement by a predetermined time space.

Figure 7:
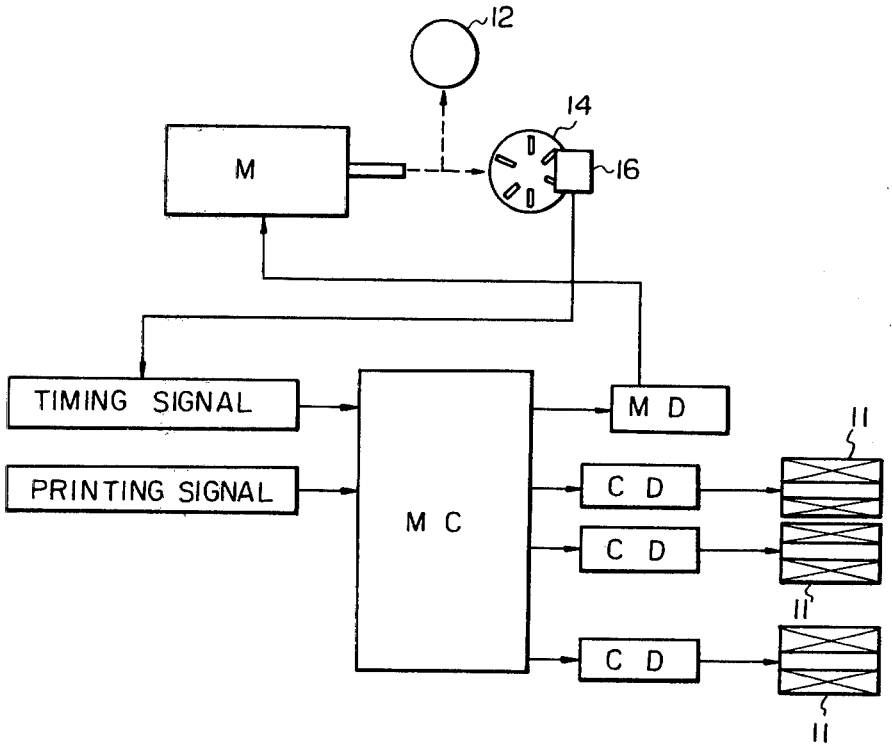
FIG. 7 is a schematic block diagram of the control circuit incorporated in the bar drive device of the invention.

FIG. 7 schematically shows the control circuit incorporated in the bar drive device of the invention and the control circuit includes a drive motor M, a microcomputer MC, a motor-driver MD and coil drivers CD.

When a printing signal is provided to the microcomputer MC, the output of the microcomputer MC is provided to the motor driver MD which in turn drives the drive motor M. When driven, the drive motor M rotates the rotary friction roller 12 and also the detection plate 14. The rotating detection plate 14 drives either one of the photoelectric elements 16 and the photoelectric element provides a timing signal to the microcomputer as the input whereby the output of the microcomputer MC drives a selected coil driver or drivers CD in a predetermined timed relationship to operate the associated coil or coils 11. The coil or coils 11 energize the associated stationary core or cores 9 which in turn cause the associated bars $5_1$, $5_2$ and/or $5_3$ to contact the rotary friction roller 12 through the associated movable core or cores 7 and ball or balls 3 to thereby effect dot printing on the recording paper by the bar or bars whereby the control circuit controls the variation in dot poisition, the recording paper feed and/or the vertical movement of the needles in an operation sequence commanded by printing command signals.

With the abovementioned construction and arrangement of the components of the needle drive device of the invention, even a small type electromagnetic device can provide a striking force sufficient to form clar and definite characters. In addition, according to the present invention, since the time space which will elapse from the inputting of a printing signal to a practical printing operation can be substantially reduced, the printing operation can be improved with respect to speed aspect.

While a few embodiments of the invention have been shown and described in detail, it will be understood that the same are for illustration purpose only and not to be taken as a definition of the invention, reference being had for this purpose to the appended claims.

What is claimed is:

1. A device for driving dot printing bars in a dot printer comprising a platen holding and feeding a recording paper, a plurality of parallel and spaced bars reciprocally movable between an inoperative position for striking against the paper to effect dot printing on the paper, said bars being normally urged to said inoperative position by spring means, a rotary friction roller facing said bars in a predetermined spaced relationships to the bars, a plurality of electromagnetic devices operating said bars to cause the bars to contact said rotary friction roller whereby when a selected one of the electromagnetic devices is energized, that device causes the corresponding bars to contact said rotary friction roller to thereby move said bar from said inoperative position to said operative striking position.

2. The device for driving dot printing bars in a dot printer as set forth in claim 1, in which said bars are supported on a common slidable guide plate and said slidable plate is moved axially of said platen by a rotary eccentric cam to shift said bars in timed relationship to the dot printing operation.

3. The device for driving dot printing bars in a dot printer as set forth in claim 2, further comprising a second guide plate adapted to move said bars in the vertical direction in timed relationship to the dot printing operation, and which is moved by a stepped rotary cam which is rotated in synchronism with said eccentric cam.

* * * * *